United States Patent [19]

Corniea

[11] Patent Number: 4,838,462

[45] Date of Patent: Jun. 13, 1989

[54] DOUBLE BELLOWS PURGE VALVE

[75] Inventor: Donald G. Corniea, Inver Grove, Minn.

[73] Assignee: Liquipak International, Inc., St. Paul, Minn.

[21] Appl. No.: 36,992

[22] Filed: Apr. 10, 1987

[51] Int. Cl.[4] ..... B67D 5/40

[52] U.S. Cl. ..... 222/377; 222/378; 222/380; 222/381; 222/487; 137/493.3; 239/453; 417/435; 417/473

[58] Field of Search ..... 239/453; 417/472, 473, 417/480, 435, 558, 514; 137/493.1, 493.3; 222/207, 481.5, 482, 487, 442, 450, 380, 383, 385, 381, 377, 372

[56] References Cited

U.S. PATENT DOCUMENTS 2,492,280 12/1949 Groves ..... 137/493.3
4,174,790 11/1979 Nozawa et al. ..... 222/385
4,189,064 2/1980 O'Neill et al. ..... 222/385
4,402,461 9/1983 Mosse et al. ..... 239/453
4,602,707 7/1986 Zumwinkel et al. ..... 137/493.3 X

*Primary Examiner*—Joseph J. Rolla
*Assistant Examiner*—Steven M. Reiss
*Attorney, Agent, or Firm*—Burns, Doane, Swecker & Mathis

[57] ABSTRACT

A liquid dispensing unit is described. The unit includes a first valve element that is held within a liquid passageway by a first spring mechanism. This spring mechanism is designed to yield under pressure to allow the first valve element to move off a valve seat in the opening to allow liquid to pass through. In order to allow air that is trapped on the downstream side of the valve element to escape, air vents are provided in the first valve element. A second valve element is held under compressive force by a second spring over air vents located in the first valve element.

10 Claims, 1 Drawing Sheet

DOUBLE BELLOWS PURGE VALVE

BACKGROUND OF THE INVENTION

The present invention relates to fluid handling apparatus and in particular, to purge valves for fluid handling apparatus.

Automatic machines have been developed for filling containers with fluids, such as milk and fruit juices. The liquid is supplied from a central reservoir to a dispensing unit. The individual containers or cartons are conveyed under the dispensing unit to receive a predetermined quantity of fluid. Various devices have been proposed for such dispensing units. For examples, U.S. Pat. No. 4,402,461 issued to Mosse, et al. on Sept. 6, 1983, discloses a fluid handling apparatus having an upper bellows for receiving fluid from a main supply, a lower bellows for receiving fluid from the upper bellows, and a midsection therebetween. A filling nozzle located below the lower bellows directs the fluid therein into cartons arranged below the lower bellows.

In normal operation, the top of the upper bellows and the bottom of the lower bellows are fixed to a rigid base, and a drive mechanism attaches at the midsection. In the first half of a cycle, the drive mechanism raises the midsection, simultaneously contracting the upper bellows and expanding the lower bellows. While the upper bellows is contracting, liquid present therein is forced through the midsection into the lower bellows, which is expanding to accept the liquid.

The cycle is completed when the driven mechanism lowers the midsection, simultaneously expanding the upper bellows and contracting the lower bellows. As the upper bellows is expanding, liquid is drawn into it from the main supply. Meanwhile, the lower bellows is contracting, forcing the liquid present in it through the nozzle into a carton situated therebelow. This cycle repeats in response to reciprocating movement of the midsection.

If the double bellows fluid handling apparatus is not to be used for an extended period, the liquid contents in both of the bellows is drained. To start the double bellows fluid handling apparatus when both of the bellows are empty, a valve leading to the nozzle at the bottom of the lower bellows is manually closed by an operator. With the valve closed, the bellows are cycled repeatedly to draw liquid from the upper bellows through the midsection into the lower bellows until a sufficient level of fluid accumulates in the lower bellows.

In the patented apparatus described above, a non-return inlet valve interconnects the upper and lower bellows and allows the liquid to pass from the upper bellows into the lower bellows. In response to an increase in the fluid pressure in the upper bellows, the inlet valve opens against the restraining force of a spring.

A problem with the prior art apparatus is that when the valve interconnecting the lower bellows and the nozzle is closed, the air in the lower bellows cannot easily escape to make room for the incoming liquid. This air is not easily released through the valve interconnecting the upper and lower bellows because of the liquid flowing from the upper bellows into the lower bellows. Thus, the priming of the system, i.e., the initial filling of the lower bellows, is impeded by the resistance the escaping air encounters.

OBJECTS AND SUMMARY OF THE INVENTION

It is therefore an object of the present invention to provide a dispensing unit having a valve that is able to let liquid pass through it in one direction into a chamber while permitting air to escape from the chamber.

It is another object of the present invention to provide a dispensing unit of the double bellows type in which the lower bellows can be filled rapidly after being emptied.

Yet another object of the present invention is to provide a dispensing unit that operates reliably and efficiently.

Briefly described, the aforementioned and other objects are accomplished according to the present invention by providing a dispensing unit of the double bellows type having a valve element that is positioned within the liquid passageway between the bellows. The valve element is spring biased to close the passageway, but to yield during the upward stroke of the midsection when the fluid pressure in the upper bellows is greater than the fluid pressure in the lower bellows. This pressure differential lifts the valve element off it seat, thereby allowing liquid to flow from the upper bellows to the lower bellows.

The valve element has air vent holes passing therethrough. A second valve element is biased to close the air holes by a second spring mechanism. When sufficient pressure builds up in the lower bellows on the downstream side of the second valve, the second spring mechanism yields to the pressure and the second valve element moves to open the air vent holes, thereby allowing air to escape. In this manner, air that is trapped in the lower bellows is allowed to escape through the air holes, and the filling of the lower bellows occurs more rapidly and more efficiently.

BRIEF DESCRIPTION OF THE DRAWINGS

A preferred embodiment of the present invention is described in greater detail with reference to the accompanying drawings, wherein like members bear like reference numerals and wherein.

DETAILED DESCRIPTION OF THE INVENTION

Figure 1:
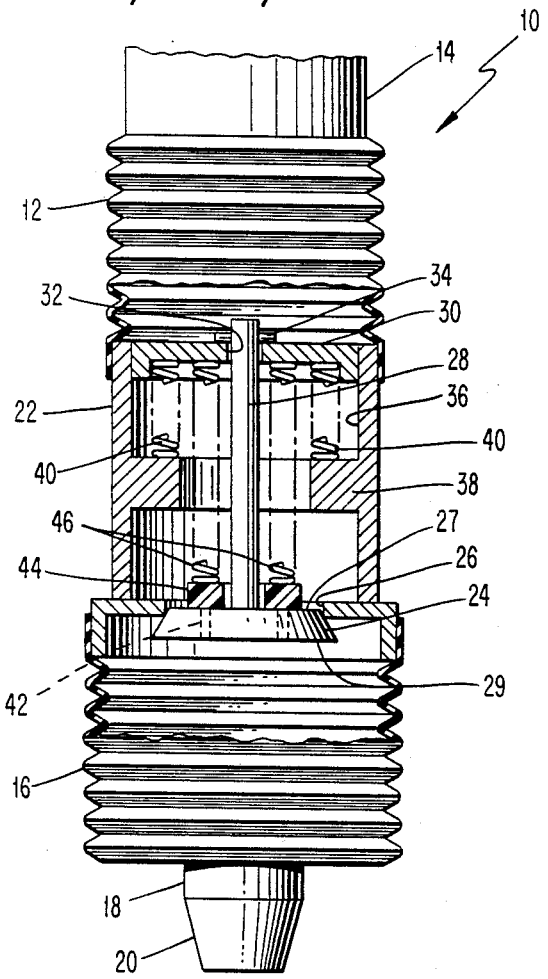
FIG. 1 is a side view, in partial cross-section, of the dispensing valve of the present invention in closed position.

With reference to FIG. 1, a dispensing valve 10 according to the present invention is incorporated in a double bellows fluid handling assembly. An example of a bellows assembly of this type is shown in U.S. Pat. No. 4,402,461. An upper bellows 12 is connected with a fixed inlet pipe 14 mounted at the upper end of the bellows. The inlet pipe 14 is provided to deliver liquid from a main supply (not shown) to the upper bellows 12. A lower bellows 16 has a valve 18 mounted at its lower end and a nozzle 20 is mounted below the valve 18 for filling cartons (not shown).

The dispensing valve 10 according to the present invention is arranged in a rigid tubular body 22 between the upper bellows 12 and the lower bellows 16. The bellows 12 and 16 are sealed to the body 22 to avoid leakage. The valve 10 includes a first valve element 24 that is preferably of a frustoconical shape and made of an elastomeric material. The first valve element 24 is designed to fit sealingly within a circular valve seat 26 that is located near the bottom of the valve 10 such that all fluids passing through the valve 10 must pass between the valve 24 and the valve seat 26. Because of the frustoconical shape of the first valve element 24, the valve element centers itself on the valve seat 26 upon closing. As soon as the valve element 24 is displaced downward slightly from the valve seat 26, fluid may pass downwardly between the valve 24 and the seat 26.

The first valve element 24 has two parallel flat circular surfaces 27 and 29. The upper surface 27 has a smaller diameter than the lower surface 29. A valve stem 28 projects perpendicularly from the center of the upper surface 27 of the first valve element 24.

Situated parallel to the first valve element 24 is a circular plate 30 having an opening 32 in the center thereof. The valve steam 28 projects through the opening 32, and is retained therein by a pin 34 mounted through and at the end of the stem 28 such that the plate 30 is between the pin 34 and the first valve element 24. The pin 34 is of a larger length than the opening 32 such that the pin 34 limits the upward displacement of the plate 30 relative to the valve stem 28.

The plate 30 is guided for vertical movement within a cylindrical wall 36. A ring 38 is rigidly attached to the interior of the midsection 22, which is similarly rigidly attached to the lower edge of the upper bellows 12 and to the upper edge of the lower bellows 16. A first spring means 40, which may comprise one or more springs, is compressed between the top surface of the ring 38 and the bottom surface of the plate 30. In this arrangement, the spring means 40 exerts an upward force on the plate 30, which in turn contacts and forces upward the pin 34 mounted on the valve stem 28. The spring means 40 accordingly urges the first valve element 24 into sealing relationship against the valve seat 26.

Figure 2:
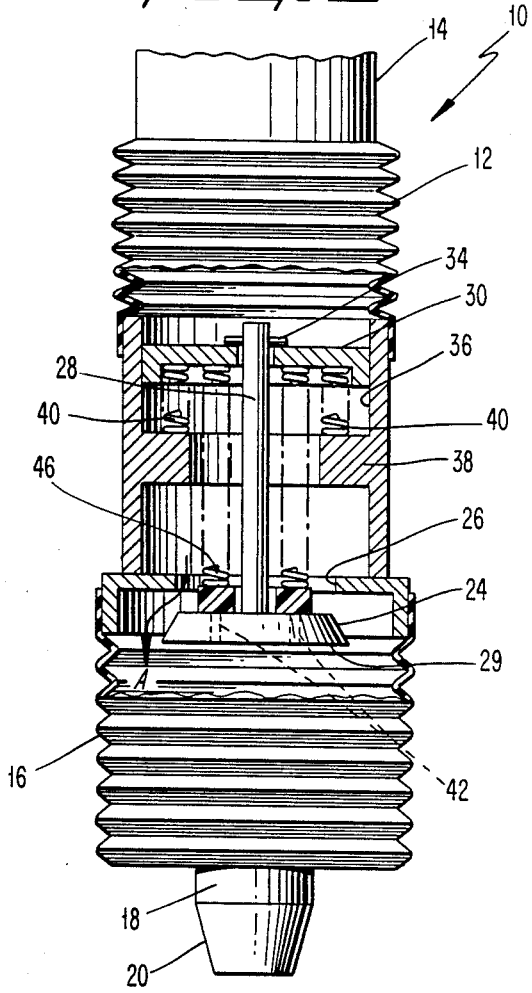
FIG. 2 is a side view, in partial cross-section, of the valve of the present invention in open position.

With reference to FIGS. 1–3 and 5, air vents 42 extend in a circular arrangement through the first valve element 24. A ring-shaped check valve element 44, preferably made of an elastomeric material, is arranged around the valve stem 28. As shown in FIGS. 1 and 2, and the valve element 44 seats against the upper surface 27 of the valve element 24 so as to effectively seal against the downward flow of fluid through the air vents 42. A second spring means 46, which may comprise one or more springs, is compressed between the bottom surface of the plate 30 and a top surface 27 of the valve element 44 to urge the valve element 44 toward the position shown in FIGS. 1 and 2.

Figure 3:
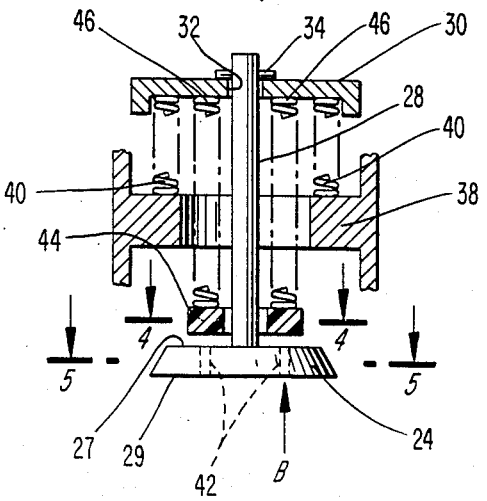
FIG. 3 is a side view of a portion of the valve of the present invention illustrating the air vents in open position.
Figure 4:
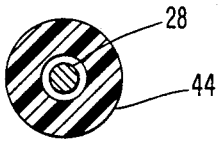
FIG. 4 is a cross-sectional view of the valve along the line 4-4 in FIG. 3.
Figure 5:
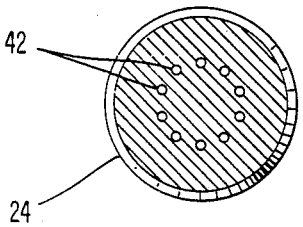
FIG. 5 is a cross-sectional view according to line 5—5 in FIG. 3.

With reference to FIG. 3, when a fluid, such as air, in the lower chamber 16 applies pressure through the air vents 42 against the valve element 44 sufficient to overcome the force of the spring means 46, the valve element 44 is raised off the air vents 42. The raising of the valve element 44 allows air in the lower bellows 16 to escape through the air vents 42. The spring should have sufficient strength to maintain the valve element 44 seated against the valve surface 27 until the midsection 22 begins its downward stroke.

The size of the air vents 42 can be of relatively small diameter, but when the liquid product being dispensed contains pulp, such as orange or grapefruit juice, the pulp may clog small vents. Thus, the vents should be sufficiently large to avoid clogging. Furthermore, larger vents will allow the escape of liquid product in the event that there is a stoppage in the lower valve 20. Relief of this back pressure avoids damage to the lower bellows.

In normal operating mode, liquid is successively pumped from the upper bellows 12, through the midsection 22 into the lower bellows 16 by the vertical reciprocating motion of the midsection 22. The liquid then passes from the lower bellows 16 through the valve 18 and the nozzle 20 into a carton to be filled (not shown).

When priming the apparatus, the valve 18 is manually closed while the double bellows 12,16 are cycled repeatedly. During this priming mode, air is initially present in the lower bellows 16. When the priming starts, the valve 10 is in a closed position, as shown in FIG. 1, so that neither liquid nor air can pass through it because the spring means 40 is maintaining the valve element 24 sealingly against the valve seat 26 and the spring means 46 is holding the valve element 44 in sealing relation over the air vents 42. Liquid from the inlet pipe 14 fills the midsection and the upper bellows.

During the upward stroke of the midsection 22, the upper bellows 12 is contracting and the lower bellows is expanding. The pressure differential between the two bellows overcomes the force of the first spring means 40, and the valve element 24 is displaced away from the valve seat 26. This displacement creates an opening through which the liquid can pass, as represented by the arrow "A" in FIG. 2.

Air that is present in the lower bellows during the priming mode is displaced by the inflowing liquid progressively from the bottom of the bellows toward the top, and collects under the lower surface of the valve 24. When the midsection 22 reaches the top of its stroke, the valve 24 closes under the force of the spring 40. Downward movement of the midsection 22, with the valve 24 closed, creates a pressure differential across the valve 24 that causes the second valve element 44 to be lifted off of the air vents 42, thus allowing the air to escape as represented by the arrow "B" shown in FIG. 3. Since the bellows are mounted vertically, the air that is purged from the lower bellows rises through the liquid in the upper bellows and enters the fill pipe 14 and passes into the supply tank where it is vented to the atmosphere.

Since the air that otherwise would be trapped in the lower bellows 16 is allowed to escape through the vents 42, liquid from the upper bellows can fill the entire volume of the lower bellows almost immediately. This enables the dispensing valve to begin filling cartons almost immediately after liquid flow is resumed after cleaning or equipment shut down.

It has been found that in normal operation the air can be purged from the lower bellows in six (6) cycles, or less.

It is, of course, possible to embody the invention in other specific forms than those of the preferred embodiment described above. This may be done without departing from the essence of the invention. The preferred embodiment is merely illustrative and should not be considered restrictive in any way. The scope of the invention is embodied in the appended claims rather than in the preceding description and all variations and changes which fall within the range of the claims are intended to be embraced therein.

What is claimed is:

1. A liquid dispensing unit comprising:

a body having a valve seat;

a first variable volume chamber on one side of said body and a second variable volume chamber on the other side of said body;

valve element means cooperating with said valve seat for controlling the flow of fluid from said first chamber to said second chamber;

first spring means for urging said valve element means toward sealing relation against the valve seat;

an inlet pipe for supplying liquid to said first chamber;

a discharge nozzle communicating with said second chamber; said body being movable relative to said pipe and said nozzle, said first and second chamber being arranged to expand one of said chambers and contract the other of said chambers upon movement of said body relative to said pipe and nozzle;

said valve element means being arranged to move off the valve seat in response to a predetermined fluid pressure in the first variable volume chamber to allow fluid to flow from the first variable volume chamber to the second variable volume chamber;

said valve element means including air vents; and control means for opening said air vents when fluid pressure in said second chamber exceeds a predetermined pressure, whereby air trapped in said second chamber bleeds through said air vents.

2. The liquid dispensing unit according to claim 1, wherein said valve element means includes a valve element with a valve stem and a plate arranged on the valve stem at the end of the stem opposite the valve element, said spring means being interposed between said body and said plate to urge said valve element means toward said valve seat.

3. The liquid dispensing unit according to claim 2, wherein said air vents include a plurality of openings through said valve element means, said control means includes a stop element and second spring means for urging said stop element toward a position covering said openings.

4. The liquid dispensing unit according to claim 3, wherein the spring force of said first spring means is less than the spring force of said second spring means, whereby said stop element opens said air vents only during filling of said second chamber.

5. The liquid dispensing unit according to claim 1, wherein the body is tubular and said valve element means is located within the tubular body.

6. A liquid dispensing unit comprising:

a stationary liquid supply pipe;

a stationary discharge nozzle;

a body mounted for reciprocating movement between said pipe and said nozzle;

a first expandable bellows between said body and said pipe and a second expandable bellows between said body and said nozzle;

said body including a valve having a valve seat and a movable valve element, said valve element being positioned relative to said valve seat to be urged away from said valve seat in response to greater fluid pressure in said first bellows than in said second bellows and to be urged toward said valve seat in response to greater fluid pressure in said second bellows than in said first bellows;

first spring means urging said valve element toward said valve seat; said valve element having air vents for conducting air through said element; and vent control means including a vent closure element and second spring means urging said closure element to close said vents, said closure element being urged to open said vents when the fluid pressure in said second bellows is greater than the pressure in said first bellows.

7. The liquid dispensing unit according to claim 6, wherein said valve seat is circular and said valve element is frustoconical and has an upper and lower surface.

8. The liquid dispensing unit according to claim 7, wherein said air vents extend between the upper and lower surfaces of said valve element.

9. The liquid dispensing unit according to claim 8, wherein the closure element is a ring, said valve element having a stem connecting the valve element and the plate, said ring element being movable to engage the upper surface of said valve element and to cover said air vents.

10. The liquid dispensing unit according to claim 6 wherein said valve element includes a valve stem and includes a plate slidably mounted on said valve stem, said first spring means engaging said plate.

* * * * *